United States Patent [19]

Ingels

[11] 4,333,651

[45] Jun. 8, 1982

[54] BALL STRIKING GAME

[76] Inventor: Luis Ingels, 242 S. Irwindale, Azusa, Calif. 91702

[21] Appl. No.: 101,500

[22] Filed: Dec. 10, 1979

[51] Int. Cl.[3] ..... A63B 71/00

[52] U.S. Cl. ..... 273/129 V; 124/38

[58] Field of Search ..... 273/129 V, 129 W, 85 R, 273/85 A, 85 B, 86 H, 87 R, 87 A, 87 B, 87 C, 87 D, 87 H, 87.2, 87.4, 88; 124/7, 8, 16, 37, 38

[56] References Cited

U.S. PATENT DOCUMENTS 747,646 12/1903 Sandstrom ..... 273/129 V 2,719,716 10/1955 Sawtelle ..... 273/129 V 2,722,211 11/1955 Eisele ..... 273/129 V

*Primary Examiner*—Richard C. Pinkham

*Assistant Examiner*—T. Brown

*Attorney, Agent, or Firm*—Donald D. Mon

[57] ABSTRACT

A game in which a club is provided having a handle and a head for striking a ball toward a target. The club head has a pivoted striker plate which is spring biased and latched to snap open and strike a ball placed adjacent the face. The latch in the head locks the striker plate closed and a plunger is provided for releasing the striker plate to strike a ball toward a target. The handle includes means for adjusting the bias on the spring operating the striker plate to vary the striking force.

12 Claims, 6 Drawing Figures

42
44
4
4
20
12
34
36
16
22
30

42
14
20
12
34
5
5
32
36
30
16

14
42
12
28
36
30
50

42
12
38
40
30
36
52
34

48
46
10
12
14
30
50
51

48

46
47
56
42
10
60
58
15
14
15
54
44
28
20
12
38
24
32
22
27
26
16

BALL STRIKING GAME

BACKGROUND OF THE INVENTION

This invention relates to a game in which a club having a handle and a head used to strike a ball toward a cup or target.

This invention also relates to a game similar to that in which a club is used to strike a ball toward a cup. In the latter game the club head is moved by swinging a shaft having a handle to strike the ball. The force and aim largely depends upon the person doing the shooting.

With the present invention the club is held stationary and a pivoted spring biased striker plate or blade in the club head is used to strike a ball toward the cup. The striker plate is cocked by a mechanism which is comprised of a latch in the club head which holds the club face closed against the biasing acting of the spring. The cocked striker plate is released by a plunger engaging the latch which extends up through the shaft for depression by a finger.

The object of the present invention is to provide a game in which a club having a handle and a head has a moving striker plate for striking a ball toward a cup.

The object of the invention will become apparent from the following description in conjunction with the drawings wherein.

DESCRIPTION OF THE PREFERRED EMBODIMENT

Figure 2:
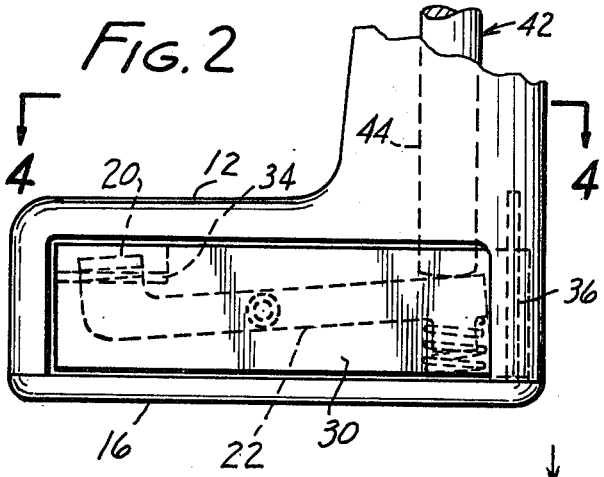
FIG. 2 is a partial section of the club head.

A club for playing the game is illustrated in FIG. 1 through 5 and is comprised of a tubular handle 10 attached to a head 12 by means of a shank 14. The end of the handle 10 slips inside of the shank 14 and is retained by resilient rings 15 engaging groves in the shank. A base plate 16 is attached to the handle by any suitable means. Inside the head 12 is a latch 20 operated by a lever arm 22 which pivots at screw 24. The latch is biased downward by a coil spring 26 engaging a stud 27 on the end of the lever arm 22.

The latch 20 functions to hold a striker plate 30 closed against the force of coil spring 28. This is accomplished by the lip 32 of the latch 20 engaging a slot 34 on the top edge of striker plate 30.

FIG. 2 illustrates the striker plate closed and latched. The striker plate 30 comprises the face of the club head 12 and is pivoted on a pin 36. When in the closed position as shown in FIG. 2 the club is ready for shooting a ball which will be described in greater detail hereinafter.

The striker plate 30 is operated as by means of coil spring 28 having an extension 38 engaging a groove 40 on the rear surface of the striker plate.

Figure 3:
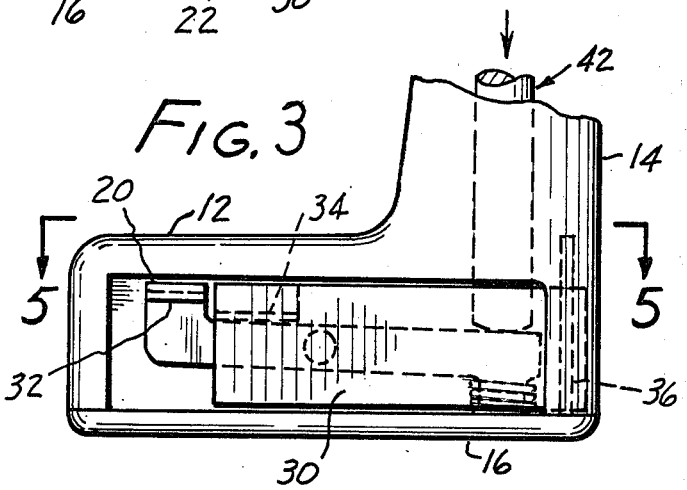
FIG. 3 is a view of the club head with the striker plate open.
Figure 4:
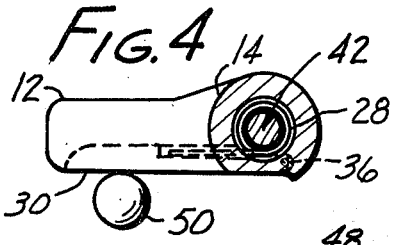
FIG. 4 is a view of the club head taken at 4—4 of FIG. 2.
Figure 5:
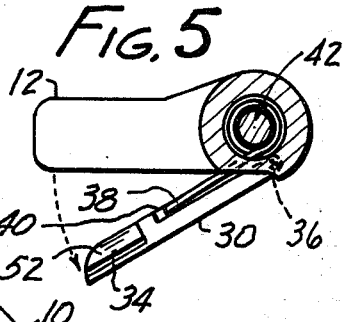
FIG. 5 is a view of the club head taken at 5—5 of FIG. 3.

FIGS. 2 and 4 are a front view and top view respectively illustrating the club head in position for shooting a ball 50. FIGS. 3 and 5 are a front view and atop view respectively illustrating the club head 12 immediately after shooting a ball.

The striker plate 30 is operated by means of a plunger 42 comprised of a shaft 44 engaging the end of the lever arm 22 opposite the latch 20 and a knob 46 for operation by a finger 48. The plunger 42 slips up into the handle 10 and is retained by a shoulder 47. The finger pressure on the knob 46 pushes the plunger 42 down pivoting the lever arm 22 to release the lip 32 from the groove 34 in the striker plate 30 allowing the extension 38 to to rapidly swing the striker plate 30 open to strike the ball. The striker plate 30 is reset (i.e. cocked) by merely closing with the cam surface 52 forcing the lip 32 of latch 22 upward causing it to slip into the slot 34.

The force applied to the striker plate by the extension 38 of the coil spring 28 may be adjusted by means of the tubular handle 10. The interior end of the tubular handle 10 has a hole 54 engaging an end of the coil spring 28. As the tubular handle 10 is rotated counter-clockwise, as indicated by the arrow at 56, the coils of the spring 28 are tightened increasing the force of the extension 38 against the rear face of the striker plate 30. Conversely, rotating the handle 10 clockwise reduces the tension on the spring 28 thus reducing the force of the extension 38 on the striker plate 30. By this means the force with which the striker plate hits the ball 50 can be adjusted (i.e. the force of the shot) In order to prevent excessive tension from being applied to the spring 28 limit stop pins 58 and 60 are provided in the shank 13 and handle 10 respectively. This allows a 360° rotation of the tubular handle 10 providing sufficient adjustment in the force of the striker plate 30.

Figure 6:
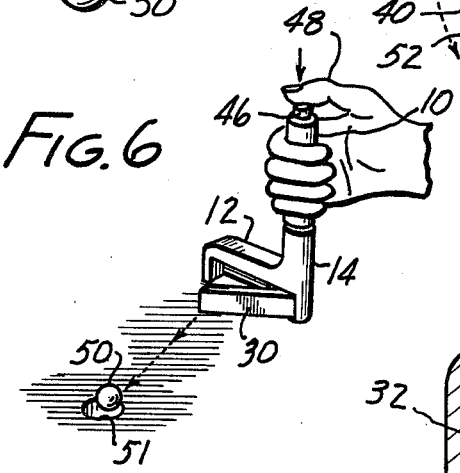
FIG. 6 is a perspective view illustrating the playing of the game.
Figure 1:
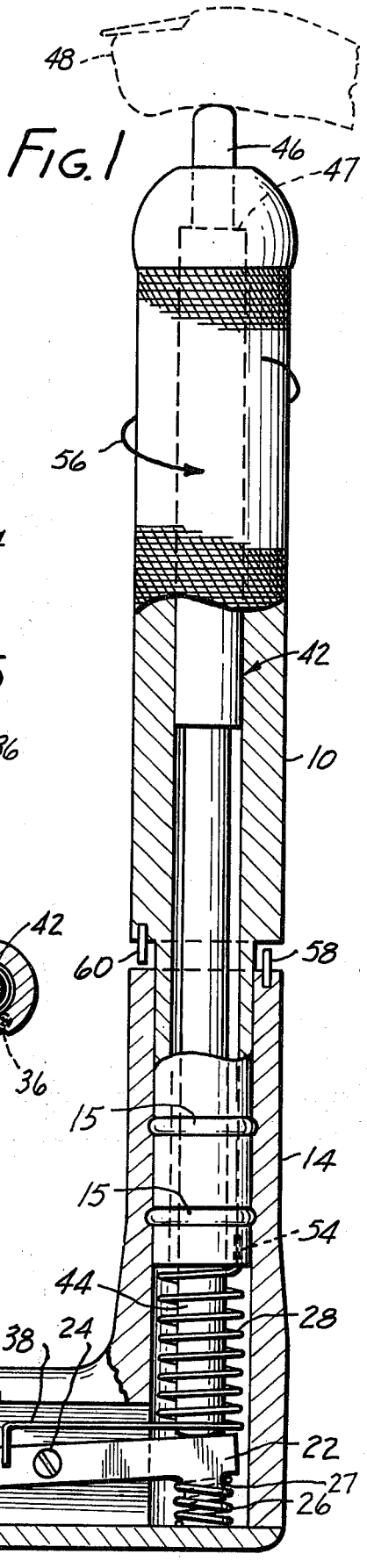
FIG. 1 is a side elevation illustrating the details in partial section of the club.

An important feature of this game is that there are no accessories needed in order to play the game. All that is needed is the club and the ball 50 as shown in FIG. 6. The club is placed with the head 12 against a flat surface and the ball 50 placed adjacent the face of the striker plate 30 as shown in FIG. 4. Almost anything can provide a target, indicated at 51, for shooting the ball at but a cup or glass layed on a carpet or floor is best. With the club and ball set-up as illustrated in FIG. 4 finger pressure on the knob 46 releases the latch 20 from the striker plate 30 allowing it to quickly swing open by means of the force of extension 38 against the back of the striker plate striking the ball 50 toward the target as shown in FIG. 6. The distance to the target can be compensated for by means of adjustment of the tubular handle to increase or decrease the force on the coil spring 28.

The advantage of the game is it can be played anywhere practically at any time with any kind of suitable small round object providing the ball 50. The ball can be a marble or some other suitable round object.

This invention is not to be limited to the embodiments shown in the drawings and described in the description, which are given by way of example and not of limitation, but only in accordance with the scope of the appended claims.

I claim:

1. In a game in which a club has a handle and a head for striking a ball toward a target the improvement comprising:

a pivoted striker plate comprising a face on said head which can pivot between an open and closed position;

a spring biasing said striker plate toward an open position;

latch means in the form of a hook on the end of a pivoted lever arm engaging a slot in said striker plate latching said plate in a closed position against the force of said spring; and release means releasing said latch means whereby said plate can swing open and strike a ball placed adjacent to said striker plate toward a target.

2. The game according to claim 1 wherein said latch means is pivotally mounted in said head behind said striker plate.

3. The game according to claim 2 wherein said release means comprises a plunger in said handle engaging the end of the pivoted lever arm opposite the latch.

4. The game according to claim 3 wherein said plunger extends outward through the end of the handle attached to said head whereby said plunger may be depressed with a finger.

5. The game according to claim 1 including means for adjusting the spring biasing force on said striker plate.

6. The game according to claim 5 wherein said means adjusting the spring biasing force comprises;

a coil spring mounted in said handle with one end of said coil abutting the striker plate.

coil tightening means engaging the other end of said spring for tightening the coils of said spring thereby increasing the biasing force of said spring.

7. The game according to claim 6 wherein said coil spring is mounted in a hollow shank attached to said club head and said coil tightening means comprises a rotating tubular member rotatably attached to said shank, the end of said tubular extension engaging the end of the coil spring.

8. The game according to claim 7 including means for limiting the rotation of said tubular member to one complete turn.

9. The game according to claim 8 wherein said rotation limiting means comprises a first pin in said hollow shank acting as a stop; a second pin in said tubular member adapted to butt against said first pin thereby limiting the rotation of said tubular member.

10. The game according to claim 7 wherein said rotating tubular member forms the handle of said club.

11. The game according to claim 10 wherein said striker plate comprises the face of said club head.

12. The game according to claim 11 wherein said latch means comprises a hook on a pivoted lever arm engaging a slot in said striker plate.

* * * * *